US006726552B2

(12) United States Patent
Wilczynski

(10) Patent No.: US 6,726,552 B2
(45) Date of Patent: Apr. 27, 2004

(54) DRAWER MOUNTED KNIFE SHARPENER

(75) Inventor: Daniel V. Wilczynski, Walbridge, OH (US)

(73) Assignee: The Edgemaker Company, Toledo, OH (US)

( * ) Notice: Subject to any disclaimer, the term of this patent is extended or adjusted under 35 U.S.C. 154(b) by 106 days.

(21) Appl. No.: 10/098,788

(22) Filed: Mar. 14, 2002

(65) Prior Publication Data

US 2002/0155798 A1 Oct. 24, 2002

Related U.S. Application Data

(60) Provisional application No. 60/285,564, filed on Apr. 20, 2001.

(51) Int. Cl.[7] ..... B24B 23/00
(52) U.S. Cl. ..... 451/349; 451/45; 76/82.2
(58) Field of Search ..... 76/82, 84, 85, 76/86, 88, DIG. 9, 82.2; 451/344, 45, 349

(56) References Cited

U.S. PATENT DOCUMENTS

| | | | | | |
|---|---|---|---|---|---|
| 2,445,039 | A | | 7/1948 | Rusnok | |
| 3,034,264 | A | | 5/1962 | McMaster | |
| 4,259,815 | A | * | 4/1981 | Kuban | 451/557 |
| 4,450,653 | A | * | 5/1984 | Fletcher | 451/552 |
| 4,558,540 | A | * | 12/1985 | Collins | 451/555 |
| 4,620,476 | A | | 11/1986 | Brym | |
| 4,640,058 | A | * | 2/1987 | Glesser | 451/552 |
| 4,646,477 | A | * | 3/1987 | Robertson | 451/540 |
| 4,663,849 | A | | 5/1987 | Nickelson | |
| 4,751,795 | A | | 6/1988 | Jenne | |
| 4,872,378 | A | | 10/1989 | Wrench | |
| 4,915,709 | A | | 4/1990 | Andrew et al. | |
| 5,233,793 | A | | 8/1993 | Dandurand | |
| 5,421,092 | A | | 6/1995 | Guilmette et al. | |
| 6,101,898 | A | * | 8/2000 | Gore et al. | 76/82 |
| 6,168,509 | B1 | * | 1/2001 | Presgrove | 451/552 |
| 6,186,460 | B1 | | 2/2001 | Lin | |

* cited by examiner

*Primary Examiner*—Timothy V. Eley
(74) *Attorney, Agent, or Firm*—MacMillan, Sobanski & Todd; Donald R. Fraser

(57) ABSTRACT

A knife sharpener holder including a first body portion swivelly attached to the vertical panel of a drawer and a second body portion pivotally attached to the first body portion and adapted to carry a knife sharpener mechanism. The knife sharpener may be disposed within the associated drawer allowing the drawer to be closed, or alternatively may be swivelled and pivoted to an operative position when the drawer is opened.

1 Claim, 2 Drawing Sheets

DRAWER MOUNTED KNIFE SHARPENER

This application is based upon Provisional Patent Application Ser. No. 60/285,564, filed Apr. 20, 2001.

BACKGROUND OF THE INVENTION

1. Field of the Invention

The present invention relates to knife sharpeners and more particularly to a knife sharpener adapted to be mounted within a drawer.

2. Description of the Prior Art

Recent development for the domestic kitchens have produced many new and improved appliances. While there are many new appliances, the counter space and cabinet space is necessarily limited. In order to overcome this problem, there have been many prior art attempts to design space saving appliances as well as multi-purpose appliances. Among the solutions to the problems of space, separate storage facilities have been designed with only limited success. Attempts have been made to design appliances which occupy neither counter nor cabinet storage space, but instead are mounted under a cabinet in space that might otherwise be wasted. While the solutions have been laudatory, the basic problem of readily available space for kitchen appliances nevertheless still exists.

SUMMARY OF THE INVENTION

It is an object of the present invention to produce a knife sharpener which may be readily mounted and stored within an existing drawer in space which would otherwise be unused, and be readily movable from the stored position to a position of use.

Another object of the invention is to produce a knife sharpener having a mounting bracket which may be easily secured to the inside vertical panel of a drawer and may be pivoted from an inoperative position to an operative position, and after use to an inoperative position with great facility.

Other objects and advantages of the invention may be readily and surprisingly achieved by a knife sharpener comprising a first body portion including a first swivel attachment bracket for mounting the first body portion to the vertical panel of a drawer to swivel about a first axis, and a second body portion including knife sharpening elements including a pivotal attachment bracket for mounting the second body portion to the first body portion to pivot about a second axis generally perpendicular to the first axis.

BRIEF DESCRIPTION OF THE DRAWINGS

The above, as well as other objects and advantages, will become readily apparent to one skilled in the art from reading the following detailed description of an embodiment of the invention in the light of the accompanying drawings in which.

DETAILED DESCRIPTION OF THE PREFERRED EMBODIMENT

Figure 1:
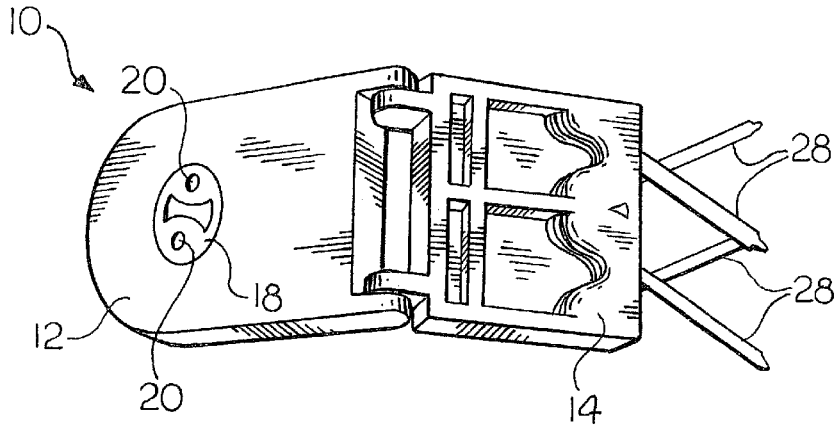
FIG. 1 is a perspective view of a knife sharpener assembly embodying the features of the invention.

Referring to the drawings, there is illustrated a knife sharpener generally indicated by reference numeral 10 which includes a first body portion 12 and an associated second body portion 14 coupled together by a pivotal connection 16.

The first body portion 12 includes a swivel attachment bracket 18 provided with holes 20 to receive suitable threaded fasteners for swivel attachment of the first body portion 12 to the vertical panel 22 of a kitchen drawer, for example. When suitably attached to the vertical panel 22 of the drawer, the first body portion 12 is capable of swivelling about a first axis which is perpendicular to the plane of the panel 22 of the drawer.

The second body portion 14 is pivotally attached to the first body portion 12 by the swivel connection 16. The pivotal connection 16 is designed to permit the second body portion 14 to pivot about a second axis which is substantially perpendicular to the first axis about which the first body portion 12 may swivel.

A plurality of steels 28 are secured to the second body portion 14 and are adapted to extend outwardly from the edge of the second body portion 14 opposite the pivotal connection 16. The steels 28 are steel rods having roughened outer surfaces capable of sharpening knifes in a well-known manner. While the use of steels 28 is illustrated, it will be understood that other types of sharpening means may be used, such as for example, whetstone wheels and the like.

In operation, the knife sharpener 10 is installed on the inside panel 22 of a drawer of a kitchen cabinet, for example, and fastened thereto by suitable fasteners such as wood screws inserted through the holes 20 of the swivel attachment bracket 18 of the first body portion 12. After the first body portion 12 is affixed to the inside of the drawer, as illustrated in FIG. 4, it will be noted that the drawer may be readily opened and closed without any interference by the knife sharpener 10.

Figure 2:
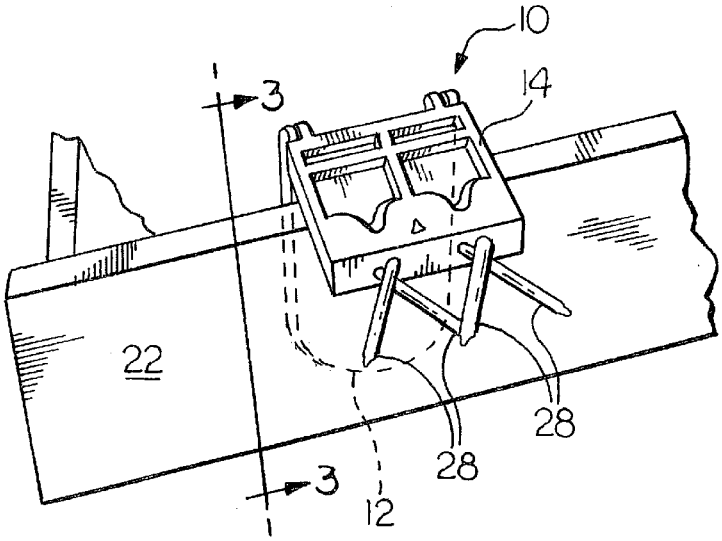
FIG. 2 is a perspective view of the knife sharpener illustrated in FIG. 1 mounted on the vertical panel of a drawer showing the knife sharpening elements of the assembly in operative position.
Figure 3:
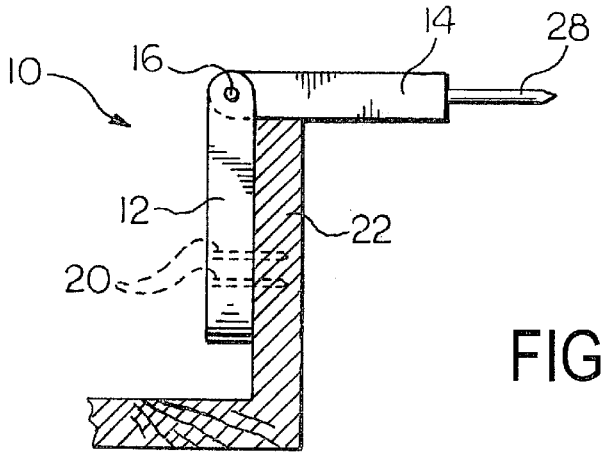
FIG. 3 is a fragmentary sectional view showing the knife sharpening elements illustrated in FIG. 2 taken along line 3—3 thereof.
Figure 4:
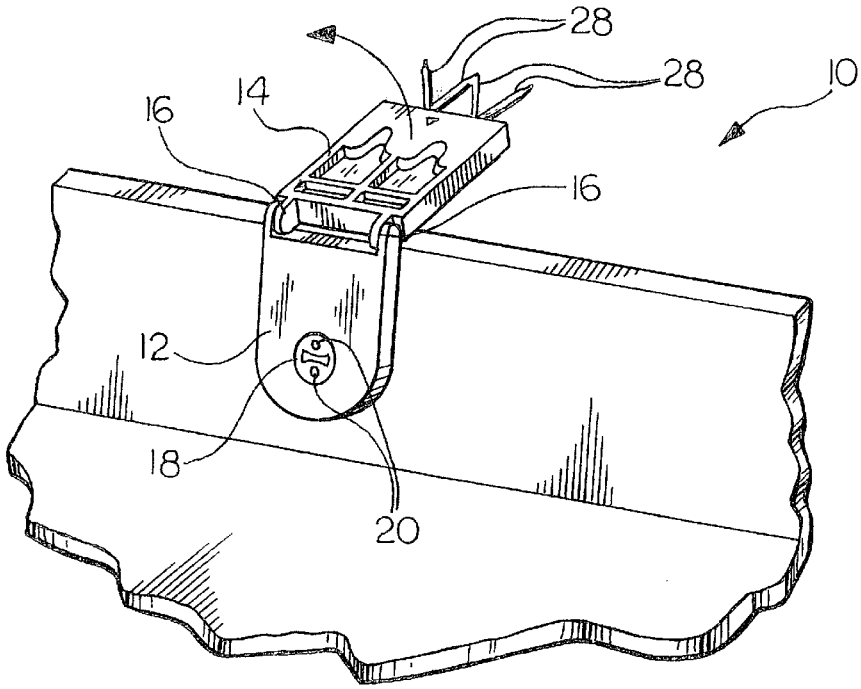
FIG. 4 is a perspective view of the knife sharpener as illustrated in FIG. 2 taken from the opposite side.

When the use of the sharpener 10 is desired, the assembly is swiveled through ninety degrees and thence the second body portion 14 is pivoted through ninety degrees about the pivotal connection 16 to a support position as illustrated in FIGS. 2, 3, and 4. The steels 28 are now in operative position to effectively receive a knife blade to be sharpened.

Figure 5:
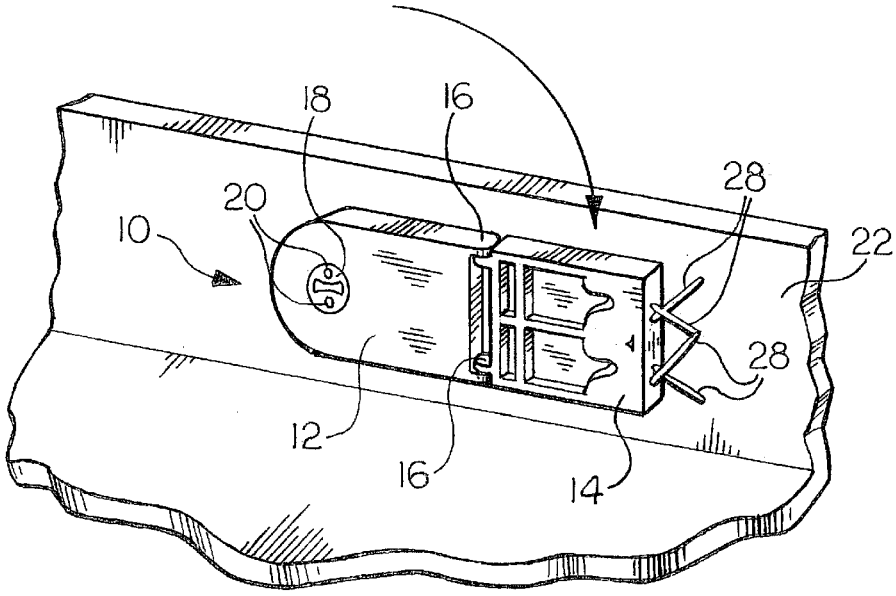
FIG. 5 is a perspective view of the knife sharpener illustrated in FIGS. 2 and 3 shown in an inoperative position within the interior of an associated drawer.

After the knife has been properly sharpened, the second body portion 14 is pivoted upwardly through approximately ninety degrees and then the entire assembly is swivelled through ninety degrees about the first axis of the swivel attachment bracket 18 to a position of non-use as shown in FIG. 5, and the drawer may be closed.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A knife sharpener comprising:

a first body portion including a swivel attachment bracket for mounting said first body portion to a vertical panel of a drawer to swivel about a first axis, the swivel attachment bracket including threaded fasteners; and a second body portion including knife sharpening elements including a pivot connection for mounting said second body portion to said first body portion to pivot about a second axis generally perpendicular to the first axis.

* * * * *